United States Patent [19]

Wankel

[11] Patent Number: 4,793,781

[45] Date of Patent: Dec. 27, 1988

[54] EXTERNAL AND INTERNAL ROTOR MACHINE HAVING INTERNAL AXES AND CIRCUMFERENTIAL REINFORCEMENT WEB

[76] Inventor: Felix Wankel, Fraunhoferstrasse 10 D-8990, Lindau, Fed. Rep. of Germany

[21] Appl. No.: 60,656

[22] Filed: Jun. 10, 1987

[30] Foreign Application Priority Data

Jun. 13, 1986 [CH] Switzerland ..... 02405/86

[51] Int. Cl.[4] ..... F01C 1/10; F01C 21/08

[52] U.S. Cl. ..... 418/168; 29/156.4 R; 74/439

[58] Field of Search ..... 418/168, 169, 166, 167; 29/156.4 R, 446, 447; 74/434, 439; 91/491; 123/44 R

[56] References Cited

U.S. PATENT DOCUMENTS

| | | | |
|---|---|---|---|
| 724,665 | 4/1903 | Cooley | 418/168 |
| 2,458,958 | 1/1949 | Pigott et al. | 418/168 |
| 2,740,386 | 4/1956 | Crandall | 418/168 |
| 3,126,833 | 3/1964 | Hill | 418/167 |
| 3,183,734 | 5/1965 | Kuntzmann | 74/434 |
| 4,714,417 | 12/1987 | Wankel | 418/159 |

FOREIGN PATENT DOCUMENTS

| | | | |
|---|---|---|---|
| 3432915 | 1/1987 | Fed. Rep. of Germany . | |
| 394985 | 7/1933 | United Kingdom | 418/168 |

*Primary Examiner*—John J. Vrablik

*Attorney, Agent, or Firm*—Ladas & Parry

[57] ABSTRACT

The engagement parts of the external rotor of a single-rotation machine are interconnected in circumferential direction of the rotor by a ring-like web. This allows high rotational speeds around the single axis of rotation of the external rotor without any increase in the size of dead spaces of the machine.

11 Claims, 4 Drawing Sheets

EXTERNAL AND INTERNAL ROTOR MACHINE HAVING INTERNAL AXES AND CIRCUMFERENTIAL REINFORCEMENT WEB

BACKGROUND OF THE INVENTION

The present invention relates to an internally axed single-rotation machine. This denomination means that an external and internal rotor are provided and each rotates around a single axis which does not change its position relative to a common casing surrounding both rotors. The rotors form as a result of their reciprocal engagement working spaces with a variable volume and openings on the circumference of the external rotor control the charge change.

A machine of this type is e.g. known from German Pat. No. 1024196. The arrangement of the rotors is comparable with that of a hollow gear and a pinion positioned therein. In the case of such machines, the engagement parts of the external rotor are relatively thin-walled beside the control openings thereof and can therefore be bent out by the pressure of the working medium and in particular by centrifugal forces. In addition, all the engagement parts of the external rotor, particularly in the case of an axially extended design of the machine are exposed to bending forces. In order to avoid such thin-walled regions, it is possible to increase the external rotor diameter. However, this leads to an enlargement of the dead spaces present at the control openings.

SUMMARY OF THE INVENTION

It is an object of the present invention to provide a reinforcement or stiffening of the external rotor without increasing the dead spaces.

In order to implement this and still further objects of the invention, which will become more readily apparant as the description proceeds, the invention contemplates an internally axed single-rotation machine, with an external rotor and an internal rotor, which are surrounded by a common casing, the rotors forming as a result of their reciprocal engagement variable volume working spaces and openings on the circumference of the external rotor control the charge change, wherein the external rotor carries for reinforcement purposes at least one circumferentially directed ring-like web, which is positioned between the two end parts of the external rotor, which axially close said rotor and which projects radially over the rotor circumference. As a result of the inventive construction, the external rotor diameter is only increased by ring-like webs interconnecting the engagement parts of the external rotor instead of on an overall basis. The webs are preferably narrow in axial direction, i.e. annular disk-like.

Beside or between the webs, the internal diameter of the casing jacket can be brought up to the external diameter of the external rotor, so that no additional clearances are formed.

The reinforcing web or webs although leading to a slight reduction in the control cross-section of the external rotor, but as a result of the invention very high rotational speeds and a long axial extension of the single-rotation machine are possible.

The at least one reinforcing web can be a fixed component of the external rotor, or can comprise a freely mounted, e.g. shrunk-on ring.

In order to permit the fitting of the external rotor in the casing jacket, the latter is either constructed in a divided form, or sleeve-like filler parts are axially inserted in the spaces provided on either side of the reinforcing web and between the circumference of the external rotor and the casing jacket.

DETAILED DESCRIPTION OF THE DRAWINGS

Figure 1:
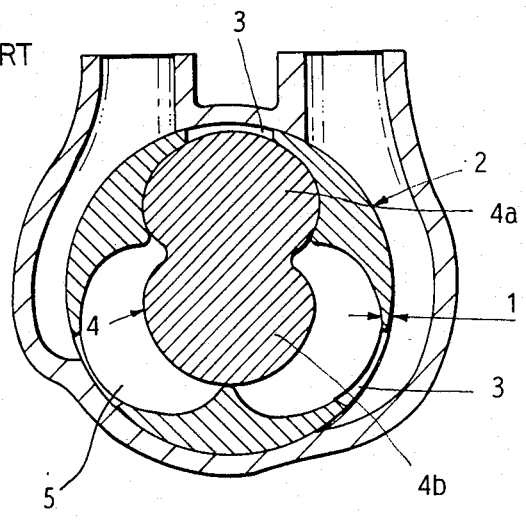
Fig. 1 PRIOR ART
FIG. 1 shows a radial cross-section through a known internal axis single-rotation machine.

With reference to FIG. 1, there is shown a radial cross-section through a known internal axis single-rotation machine. Regions 1 of the external rotor 2 are susceptible to outward bending by centrifugal forces, and there are relatively small dead spaces, indicated by reference numeral 3. Engagement parts 4*a* and 4*b* of an inner rotor 4 penetrate into cavity 5 of the external rotor 2 so as to form variable volume working spaces which communicate through space 3 with ports or openings 3*a* and 3*b* in the casing which is about the external rotor as is well known in the art.

Figure 2:
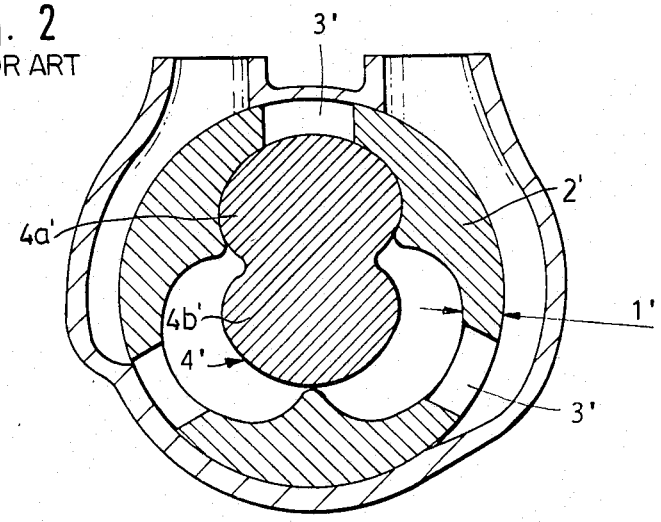
Fig. 2 PRIOR ART
FIG. 2 shows a radial cross-section through another embodiment of a known internal axis single-rotation machine.

Turning to FIG. 2, there is shown a machine comparable to that illustrated in FIG. 1, but with an enlarged diameter external rotor 2'. In this way, the regions 1' susceptible to bending by the centrifugal forces are reinforced. However, such an arrangement leads to the drawback of a corresponding increase in the size of dead spaces 3', from which the engagement parts 4*a'* and 4*b'* of the inner rotor 4' cannot displace the enclosed volume.

Figure 3:
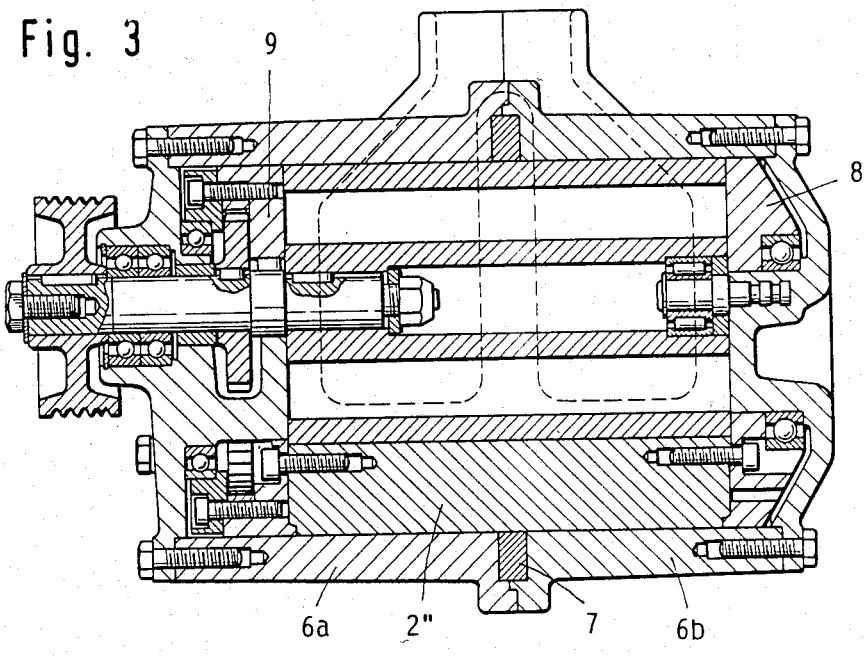
FIG. 3 shows a longitudinal section through a single-rotation machine of the invention.
Figure 4:
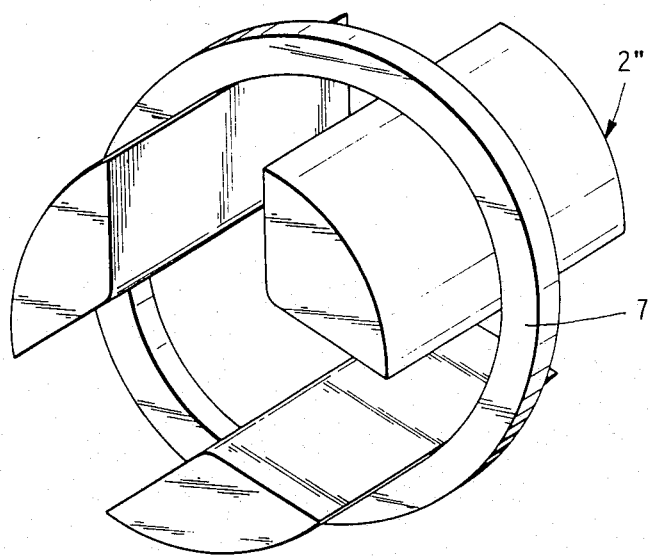
FIG. 4 shows a perspective representation of the external rotor and reinforcing web shown in FIG. 3.

A longitudinal section through a first embodiment of the single-rotation machine of the invention is shown in FIG. 3. In this figure, a casing 6*a* and 6*b* is transversely divided so that the external rotor 2'' is able to carry a shrunk-on reinforcing web 7. The external rotor 2'' has located at its axial ends closing end parts 8 and 9. In FIG. 4 of the drawings, a perspective view of the external rotor 2'' with reinforcing web 7 is shown without the closing end parts 8 and 9. In FIG. 4, only the three engagement parts are shown together with the reinforcing web 7.

Figure 5:
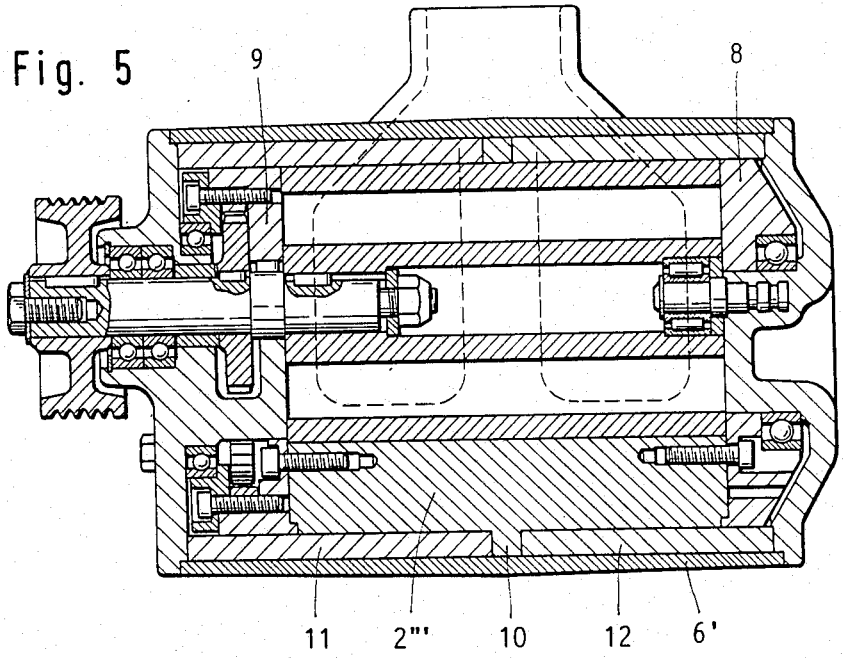
FIG. 5 shows a longitudinal section through a second embodiment of a single rotation machine of the invention.

FIG. 5 of the drawings shows in longitudinal section a second embodiment of a single-rotation machine of the invention. In this figure, the reinforcing web, designated with reference numeral 10, is conformed as one piece on the outer circumference of the external rotor 2'''. In this figure, the casing 6' is solid, and without division. The spaces between the outer circumference of the external rotor 2''' and the casing 6', on each side of the reinforcing web 10 is filled with sleeve-filler parts 11 and 12 which fit into the space.

Figure 6:
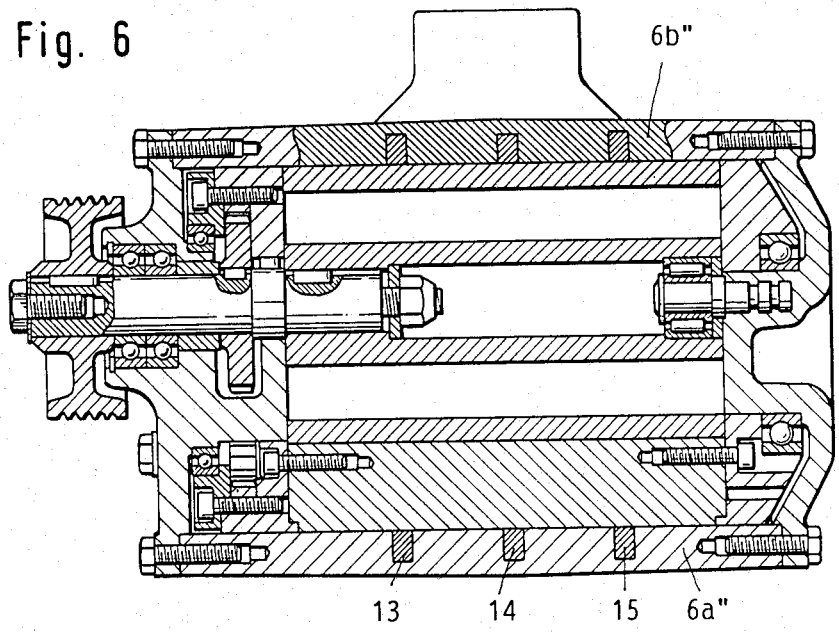
FIG. 6 shows a longitudinal section through a third embodiment of a single-rotation machine of the invention.

FIG. 6 shows a longitudinal section through a third embodiment of a single-rotation machine according to the invention. In this embodiment, three reinforcing webs 13, 14 and 15 are shown about the outer circumference of the external rotor. The reinforcing webs 13, 14 and 15 are enclosed in inner slots of the casing 6″.

Figure 7:
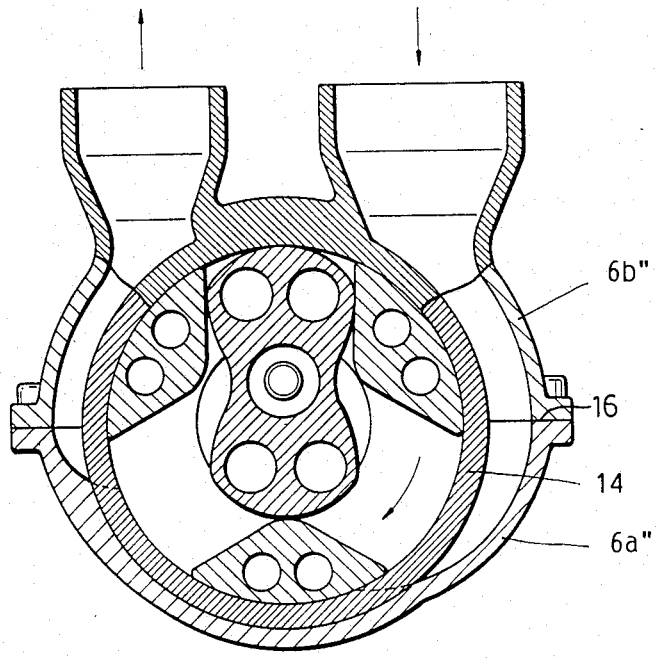
FIG. 7 shows a radial cross-section of the single-rotation machine of the invention shown in FIG. 6.

FIG. 7 shows a radial cross-section of the single-rotation machine shown in FIG. 6. In this figure, there is illustrated the longitudinal division 16, between parts 6*a*″ and 6*b*″ of the casing.

The basic construction and operation of the single-rotation machine shown and described in the drawings above are indicated in German Pat. No. DE 3432915, which corresponds to U.S. Pat. No. 4,714,417.

What I claim is:

1. An internal axis single-rotation machine comprising:

an external rotor with an outer circumference and having end parts at each end thereof which axially close the external rotor, the external rotor having openings therein extending to the circumference;

an internal rotor located in the openings of the external rotor, the external rotor and internal rotor being adapted to reciprocally engage each other as each rotates to produce variable working spaces which extend to the circumference of the external rotor;

a casing about the internal and external rotors, said casing having inlet and outlet openings communicating with said working spaces through said openings in the circumference of the rotor; and at least one circumferentially directed ring-like web about the external rotor to provide reinforcement therefor, the web being located between the end parts of the external rotor and projecting radially over the external rotor outer circumference.

2. A single-rotation machine according to claim 1 wherein the casing extends up to the circumference of the external rotor on either side of the web.

3. A single-rotation machine according to claim 2, wherein the casing is divided transversely.

4. A single-rotation machine according to claim 2, wherein the casing is divided longitudinally.

5. A single-rotation machine according to 1 wherein the casing is undivided, the spaces adjacent to the web on either side thereof and between the external rotor and the casing being filled by sleeve-like filler parts.

6. A single-rotation machine according to claim 1 wherein the external rotor carries a plurality of ring-like webs, the webs being surrounded by a casing which is divided longitudinally.

7. A single-rotation machine according to claim 1 wherein the external rotor carries a ring-like, web the web being surrounded by a casing which is divided transversely.

8. A single rotation machine according to claim 1 wherein at least one ring-shaped web is shrunk on the external rotor.

9. A single rotation machine according to claim 1 wherein the at least one ring-like web is an integral part of the external rotor.

10. A single rotation machine according to claim 1 wherein the at least one ring-like web has a radially oriented longitudinal cross-section.

11. A single rotation machine according to claim 10, wherein the at least one ring-like web has a rectangular cross-section.

* * * * *